US007774988B2

(12) United States Patent
Guitoneau

(10) Patent No.: US 7,774,988 B2
(45) Date of Patent: Aug. 17, 2010

(54) INSPECTION CHAMBER, AS WELL AS SET OF BASE PARTS THEREFOR

(75) Inventor: Hans Edward Guitoneau, Grootebroek (NL)

(73) Assignee: Pipelife Nederland B.V., Enkhuizen (NL)

( * ) Notice: Subject to any disclaimer, the term of this patent is extended or adjusted under 35 U.S.C. 154(b) by 1172 days.

(21) Appl. No.: 10/570,719

(22) PCT Filed: Sep. 13, 2004

(86) PCT No.: PCT/NL2004/000631

§ 371 (c)(1),
(2), (4) Date: Mar. 3, 2006

(87) PCT Pub. No.: WO2005/024147

PCT Pub. Date: Mar. 17, 2005

(65) Prior Publication Data

US 2007/0053750 A1 Mar. 8, 2007

(30) Foreign Application Priority Data

Sep. 11, 2003 (NL) ..... 1024276

(51) Int. Cl.
*E02D 29/12* (2006.01)

(52) U.S. Cl. ..... 52/20; 285/125.1; 220/567.1; 220/4.13; 220/4.16

(58) Field of Classification Search ..... 405/184.1, 405/184.4, 40, 41, 52, 53; 52/20, 21; 220/567.1, 220/4.12, 4.13, 4.16; 137/363; 285/125.1, 285/126.1, 129.1, 129.2, 130.1, 131.1, 132.1
See application file for complete search history.

(56) References Cited

U.S. PATENT DOCUMENTS

| | | | | | |
|---|---|---|---|---|---|
| 4,103,862 | A * | 8/1978 | Moore | 249/53 R |
| 4,177,229 | A * | 12/1979 | Moore | 264/40.5 |
| 4,253,282 | A * | 3/1981 | Swartz | 137/363 |
| 4,341,236 | A * | 7/1982 | LaBenz | 137/363 |
| 4,346,921 | A * | 8/1982 | Gill et al. | 285/110 |
| 4,867,411 | A * | 9/1989 | Dorsey et al. | 249/11 |
| 4,941,643 | A * | 7/1990 | Ditcher | 249/145 |
| 5,584,317 | A * | 12/1996 | McIntosh | 137/363 |
| 5,752,787 | A * | 5/1998 | Trangsrud | 405/154.1 |
| 6,152,650 | A * | 11/2000 | Heine | 405/36 |
| 6,968,854 | B2 * | 11/2005 | Mokrzycki et al. | 137/363 |
| 2004/0040221 | A1 * | 3/2004 | Airheart | 52/20 |
| 2005/0025573 | A1 * | 2/2005 | Waldman et al. | 405/41 |
| 2005/0161088 | A1 * | 7/2005 | Mokrzycki et al. | 137/363 |

FOREIGN PATENT DOCUMENTS

| | | | |
|---|---|---|---|
| CH | 661 552 | A | 7/1987 |
| EP | 1 174 550 | A | 1/2002 |
| GB | 1 216 874 | A | 12/1970 |
| GB | 1 363 302 | A | 8/1974 |

(Continued)

*Primary Examiner*—James M Hewitt
(74) *Attorney, Agent, or Firm*—The Webb Law Firm

(57) ABSTRACT

An inspection chamber having a plastic sleeve, a plastic base accommodated in the sleeve and at least two branches connected to the sleeve, which base has a flow profile that extends between the two branches. The base is made up of at least two separate base parts that are permanently fixed to one another at their edges facing one another, such as by welding, fusing, gluing and the like.

15 Claims, 7 Drawing Sheets

FOREIGN PATENT DOCUMENTS

| | | | | |
|---|---|---|---|---|
| GB | 2 043 195 | A | | 10/1980 |
| GB | 2 080 355 | A | | 2/1982 |
| JP | 03144019 | A | * | 6/1991 |
| JP | 05287766 | A | * | 11/1993 |
| JP | 06026065 | A | * | 2/1994 |
| JP | 06146313 | A | * | 5/1994 |
| WO | WO 9319258 | A1 | * | 9/1993 |

* cited by examiner

INSPECTION CHAMBER, AS WELL AS SET OF BASE PARTS THEREFOR

The invention relates to an inspection chamber, comprising a plastic sleeve, a plastic base accommodated in the sleeve and at least two branches joined onto the sleeve, which base has a flow profile that extends between the two branches.

Such an inspection chamber is known. With this inspection chamber there is the possibility for making up different inspection chambers from a number of shafts and bases. The length of the shafts can differ and can be chosen with a view to the installation depths of the inspection chamber. Furthermore, a choice can be made between various bases, all of which have a different pattern with branches and associated flow profile.

The disadvantage of this known inspection chamber is that a separate base is needed for each variant. This means that a large number of such bases must be held in stock. Furthermore, transport is not as easy in the case of larger diameters.

The aim of the invention is therefore to provide an inspection chamber that does not have these disadvantages and that with a limited number of variants nevertheless offers a large number of different bases. Said aim is achieved in that the base is made up of at least two separate base parts that are permanently fixed to one another at their edges facing one another, such as by welding, fusing, gluing and the like.

The base parts, each with sections of flow profiles as well as branches associated with the flow profiles of the base parts, are preferably located next to one another in a direction transverse to the axial direction of the shaft and can be made up in many different ways. The major advantage of this is that a relatively large number of bases can be obtained with a limited stock of different base parts.

What is concerned here is first of all a variant where the branches are located opposite one another and the flow profile runs straight between them. According to a further variant at least two branches are oriented at approximately 90 degrees with respect to one another and the flow profile runs in a curve between said branches. According to yet another possibility at least two branches are oriented at approximately 135 degrees with respect to one another and the flow profile runs in a curve between said branches.

In the case of the inspection chamber according to the invention the diameter can also be adapted. This can be achieved if the base comprises base parts forming a ring as well as central base parts, which base parts forming a ring are contiguous with the outer periphery of the central base parts, to the outer periphery of which base parts forming a ring the sleeve is connected, and are profiled correspondingly to the central base parts.

In order to achieve this the invention furthermore relates to a set for an inspection chamber as described above, comprising a shaft, at least two base parts with sections of flow profiles as well as branches associated with the flow profiles of the base parts. The various variants described above can be made up with the aid of a set comprising five base parts, every two of which can be combined to give a base, which base parts comprise:

- a base part with one half of a flow profile that runs straight,
- a first right base part with one section of a flow profile that runs straight and a flow profile that branches off at approximately 90 degrees from the flow profile that runs straight,
- a second right base part with one section of a flow profile that runs straight and a flow profile that branches off at approximately 135 degrees from the flow profile that runs straight,

- a first left base part with one section of a flow profile that runs straight and a flow profile that branches off at approximately 90 degrees from the flow profile that runs straight,
- a second left base part with one section of a flow profile that runs straight and a flow profile that branches off at approximately 135 degrees from the flow profile that runs straight.

Thus, in total only five different base parts have to be kept in stock in order to be able to provide all variants. The base parts each relate to only a portion of the finished base, so that storage and transport is facilitated.

An inspection chamber with a specific nominal diameter can be made up using the abovementioned set. According to a further variant of the inspection chamber according to the invention the nominal diameter can be chosen larger. To this end the set can further comprise four ring sections that can be arranged around, in each case, two combined base parts. In said ring sections there are profilings that join onto the profilings in the base parts. A shaft of enlarged diameter can then be placed on the outer periphery of said ring sections.

The shaft can be double-walled with a smooth inner tube and a ribbed outer tube fixed to the inner tube. Furthermore, a sleeve can be provided to which the shaft and the branches can be joined and within which sleeve the combined base parts can be accommodated.

To simplify the assembly of the base and to increase the rigidity and tightness thereof, the base can have a plastic end wall or plastic end ring on which the combined base parts are supported. Said end wall/end ring is preferably fixed to one end of the sleeve, whilst the other end of the sleeve is fixed to the shaft.

Reference is made to the inspection chamber base construction that is disclosed in EP-A 1 174 550. This inspection chamber base construction comprises a concrete body in which a plastic base lining is accommodated. This base lining is made up of a number of base segments that have a specific flow profile.

Such an inspection chamber base construction is used with a different type of inspection chamber to that to which the invention relates. The rigidity of the known inspection chamber is obtained by the concrete body. The shaft that is placed on the inspection chamber base also consists of rings made of a concrete material.

In contrast, the inspection chamber according to the invention relates to a completely plastic construction. The plastic base and plastic shaft have an appreciably lower weight than a concrete product. Furthermore, the plastic base and plastic shaft themselves provide the requisite strength and rigidity for the inspection chamber, without a concrete support being needed for this.

The invention will now be explained in more detail below with reference to a few illustrative embodiments shown in the figures.

FIGS. 5*a* to *i* show different variants diagrammatically in plan view.

FIGS. 6 to 9 show base parts in perspective.

FIGS. 10*a* to *i* show further different variants.

Figure 10A:
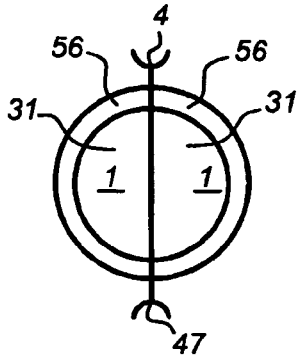
Figure 10B:
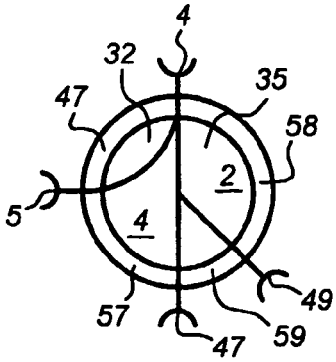
Figure 10C:
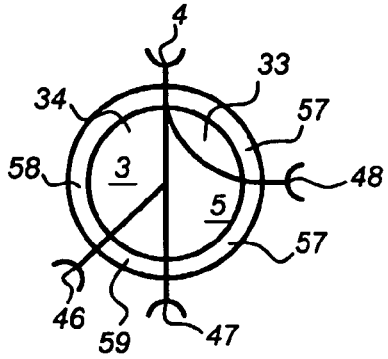
Figure 10D:
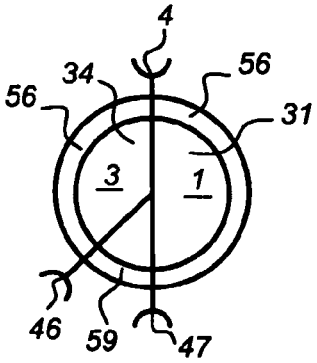
Figure 10E:
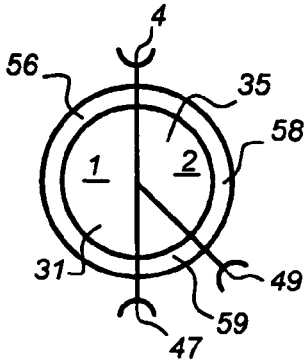
Figure 10F:
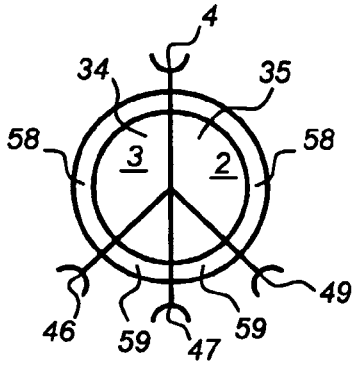
Figure 10G:
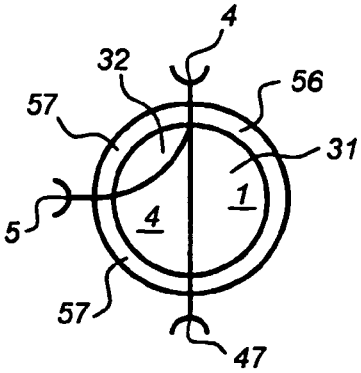
Figure 10H:
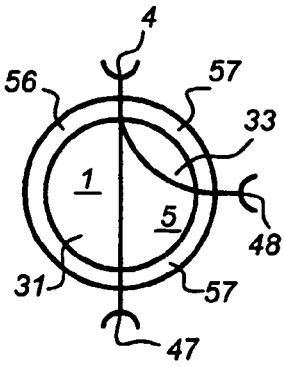
Figure 10I:
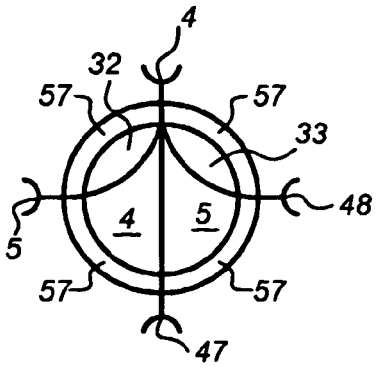
Figure 11:
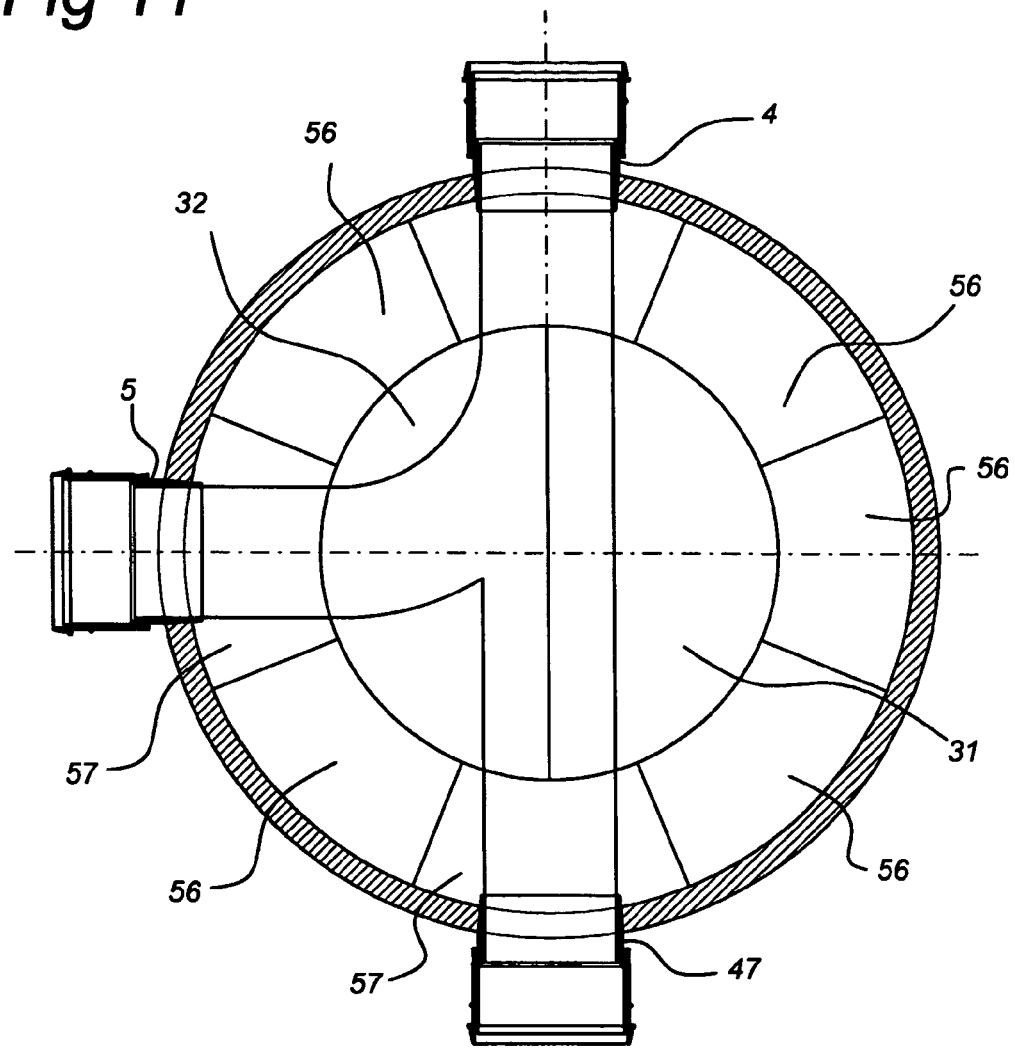

FIG. 11 shows a more detailed view of the variant in FIG. 10*g*.

Figure 1:
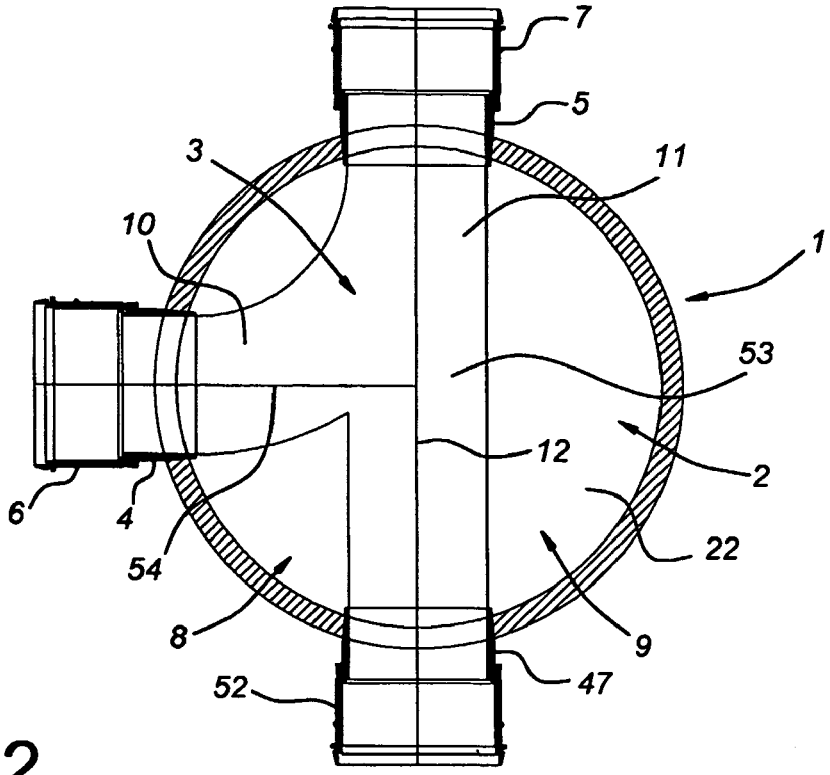
FIG. 1 shows a plan view of a first embodiment of the modular inspection chamber according to the invention.

The modular inspection chamber shown in FIG. 1, which is made entirely of plastic, comprises a shaft 1 indicated by 1, to which a base 2 is connected. The base 2 has a flow profile 3. This flow profile 3 comprises a straight section 53 and a curved section 54 branched therefrom. The curved section 54 extends between the two branches 4, 5 to which coupling joints 6, 7 are connected for further connection to pipes (not shown); the straight section extends between the branches 5, 47 with coupling joints 6, 52.

The base 2 comprises two separate base parts 8, 9, each of which contains a section 10 and 11, respectively, of the flow profile 3. The base parts 8, 9 are tightly joined to one another by means of the seam 12.

The shaft 1 and the base 2 are fixed to one another by means of the sleeve indicated in its entirety by 14. This sleeve extends with a tight fit around the shaft 1, in particular around the outer part thereof that has a convex profile. The inside of the shaft 1 has a smooth wall 16.

At the top the sleeve 14 has a rim 17 that is angled outwards, which facilitates the insertion of the shaft 1. At the bottom the sleeve 14 has a shoulder 18 around which an end ring 19 has been snap-fitted. The shaft 1 bears on the top 22 of the base parts 8, 9. This top can also be made such that it slopes somewhat downwards towards the profiling 3, such that it is always ensured that any liquid does not remain on the base parts 8, 9.

Figure 2:
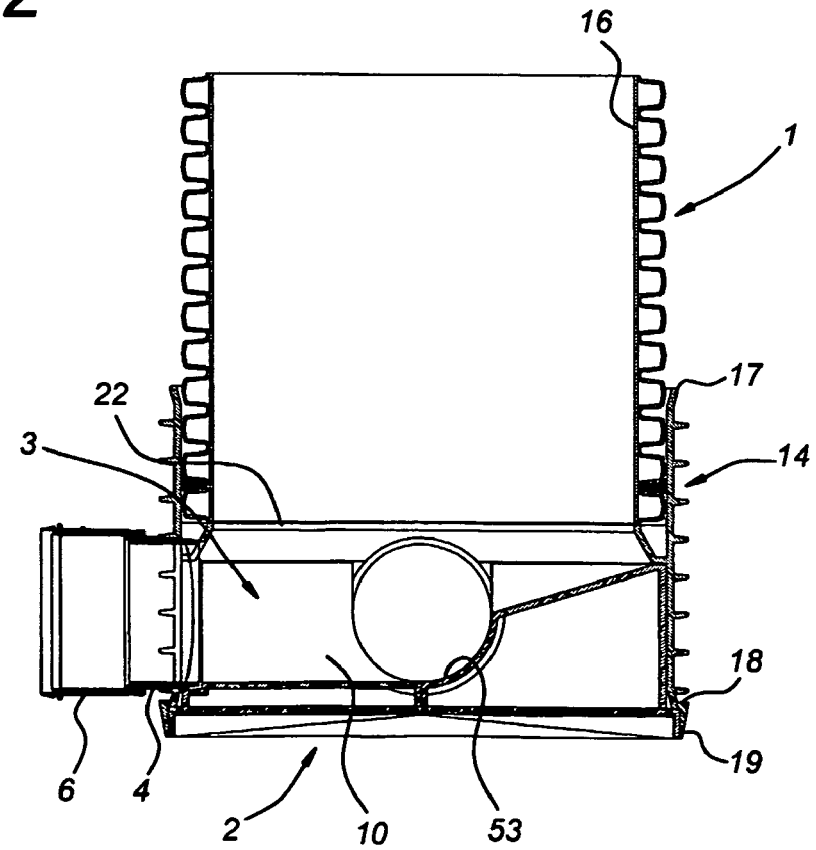
FIG. 2 shows a section along II-II in FIG. 1.
Figure 3:
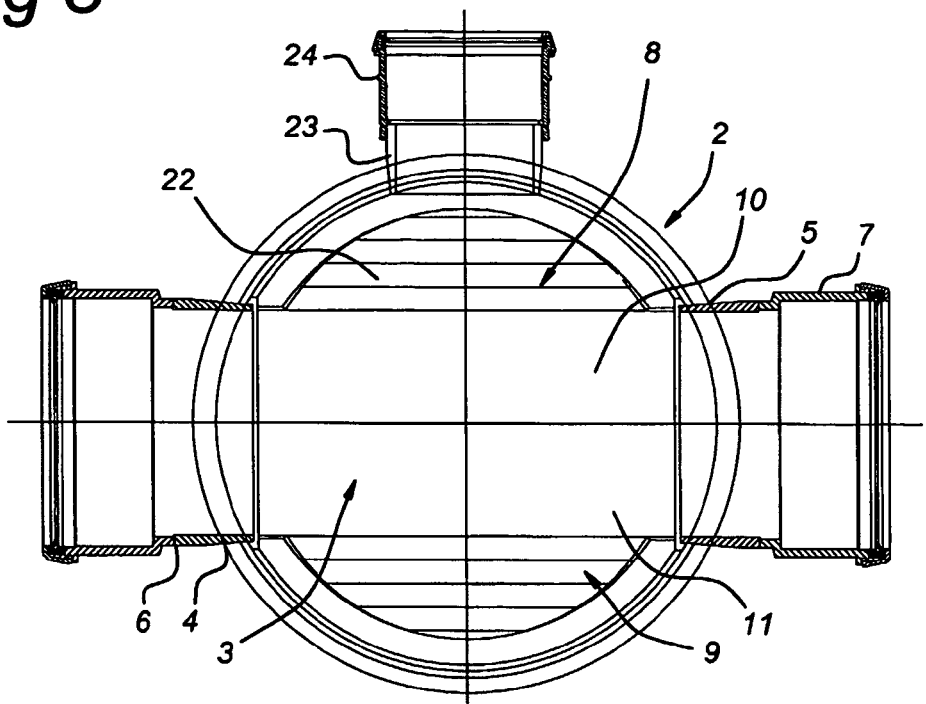
FIG. 3 shows a plan view of a second embodiment.
Figure 4:
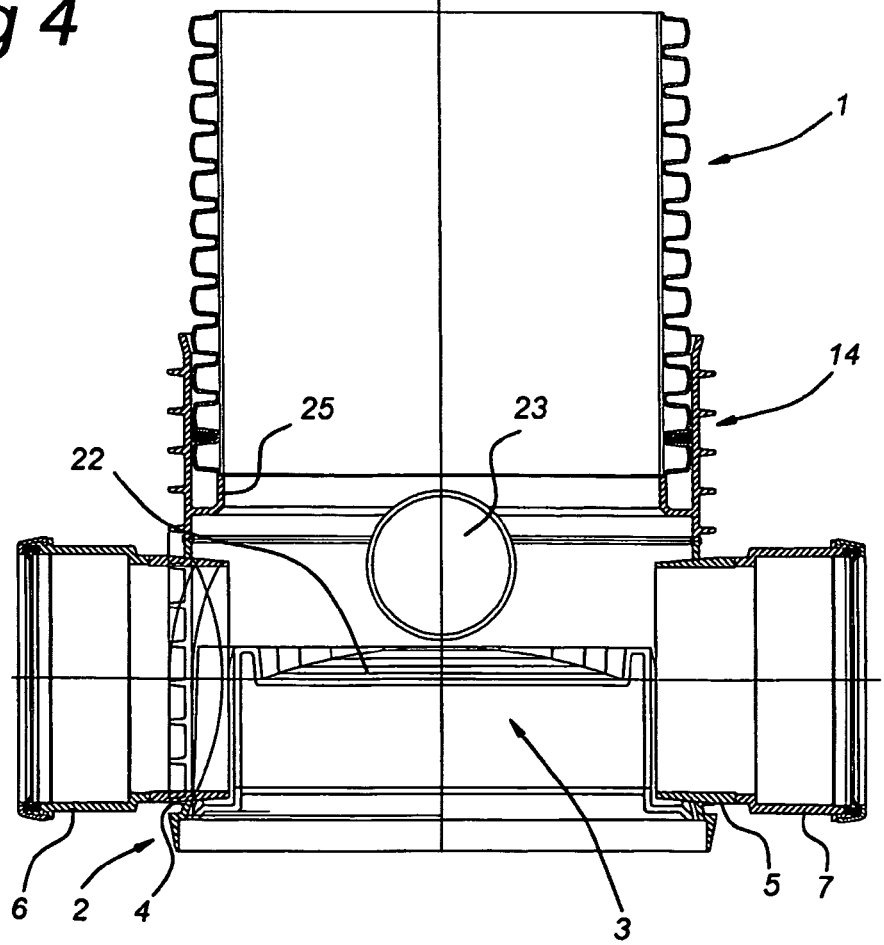
FIG. 4 shows a view along IV-IV in FIG. 3.
Figure 5A:
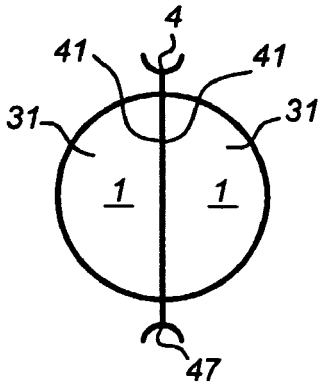
Figure 5B:
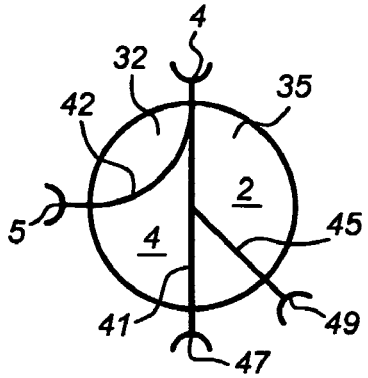
Figure 5C:
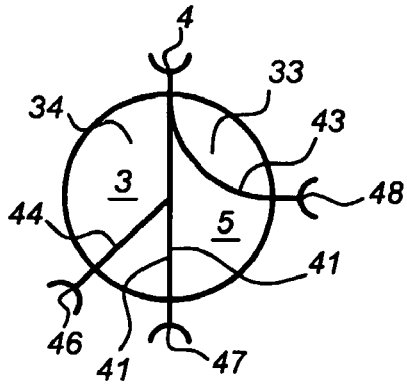
Figure 5D:
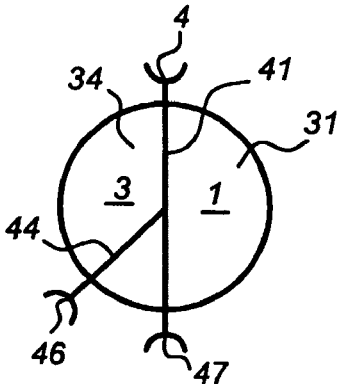
Figure 5E:
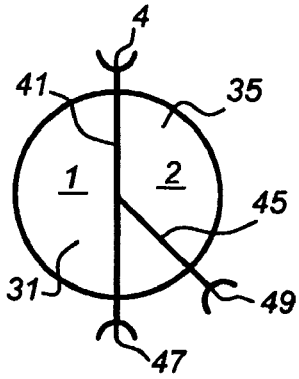
Figure 5F:
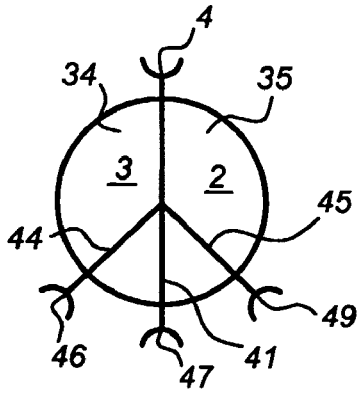
Figure 5G:
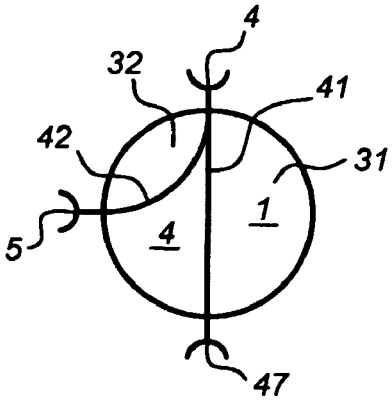
Figure 5H:
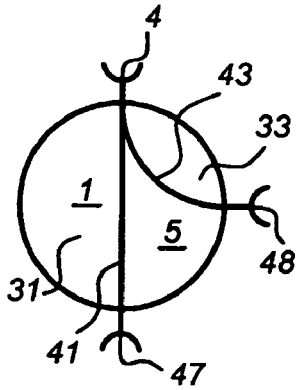
Figure 5I:
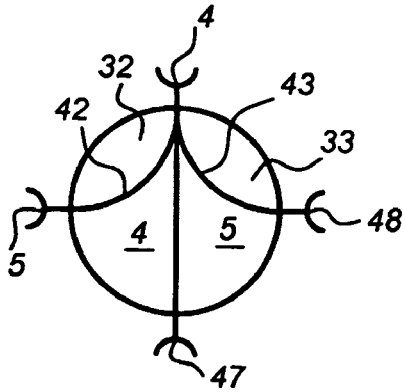
Figure 6:
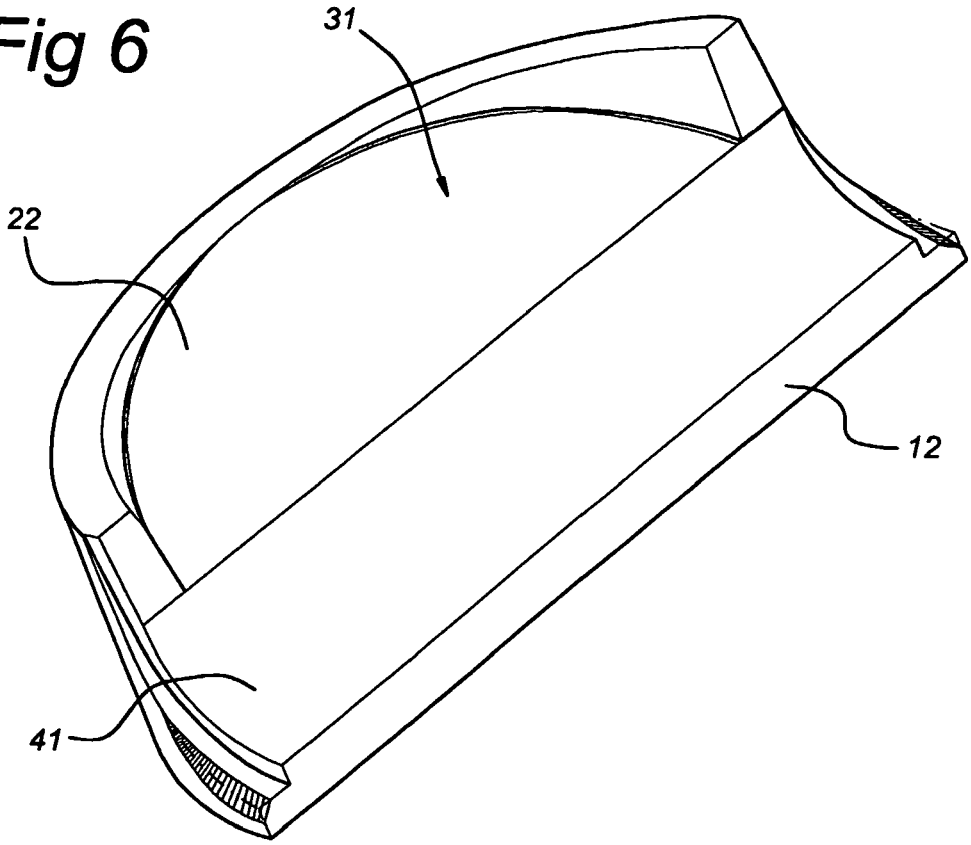
Figure 7:
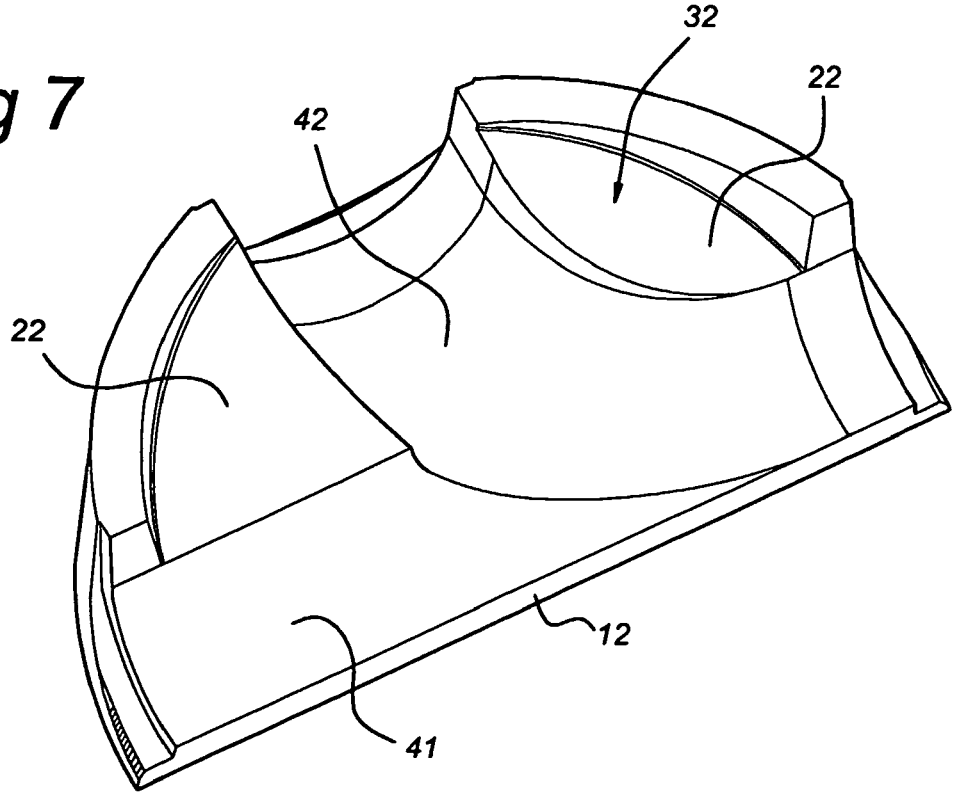
Figure 8:
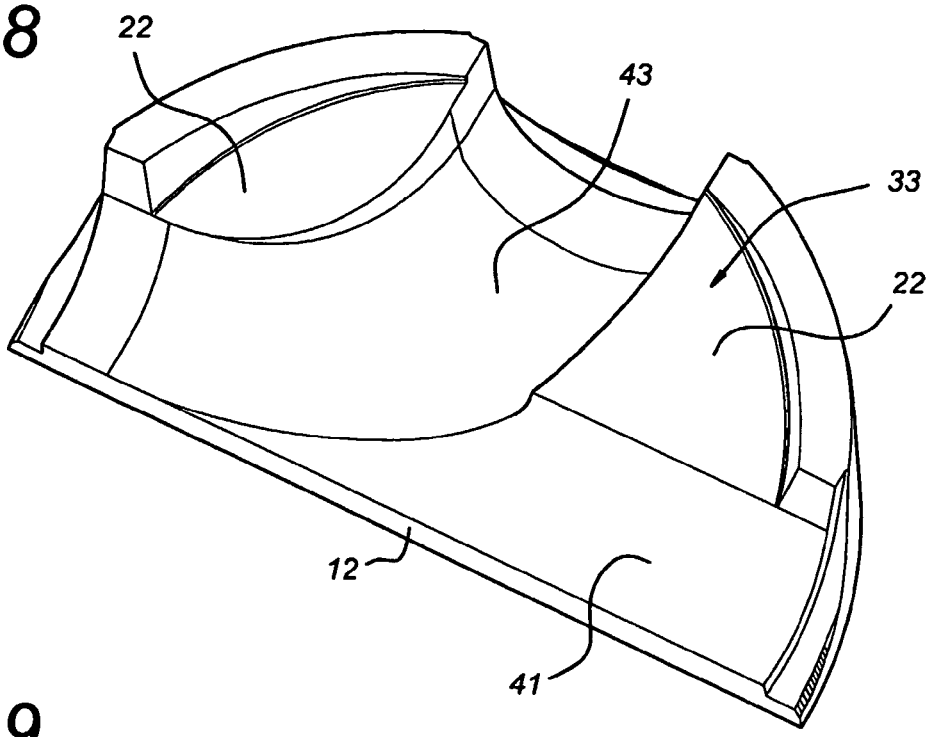
Figure 9:
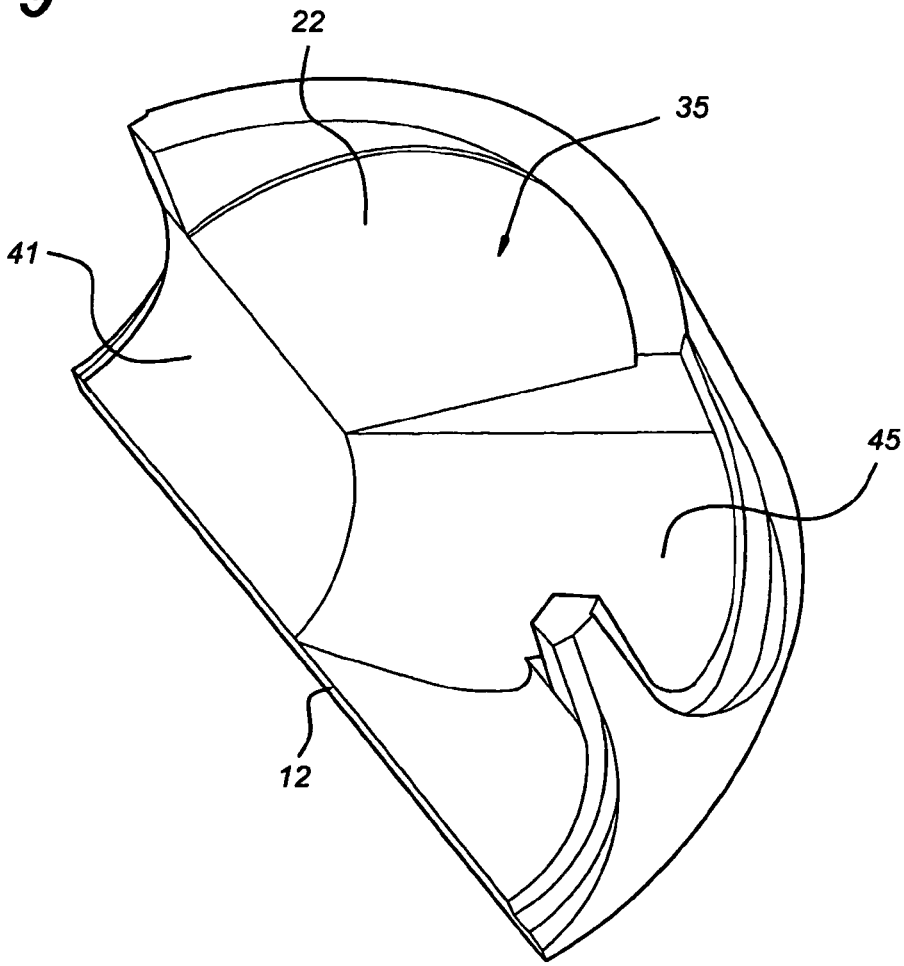

The variant of the modular inspection chamber according to FIGS. 3 and 4 is largely the same as that in FIGS. 1 and 2. The base 2 also has a flow profile 3 that in the variant in FIGS. 3 and 4 runs diametrally straight through. The coupling joints 6, 7 are then also directly opposite one another.

The base 2 is made up of the base parts 8, 9, each of which has a section 10 and 11, respectively, of the flow profile 3.

However, a subsidiary connection 23 with a coupling joint 24 is now arranged in the sleeve, which subsidiary connection 23 is at a higher level than the surface 22 of the base part 8. The sleeve also has a shoulder 25, on which the shaft 1 is supported above the subsidiary connection 23.

The surface 22 of the base parts 8, 9 slopes downwards towards the profiling 3.

Nine different variants of profiled bases, made up of five different base parts, are shown in the variant in FIGS. 5*a* to 5*i*. These base parts are the base parts 31, which have a section of a flow profile 41 that runs straight, a base part 32 with a section of a flow profile 42 that branches off to the right through 90°, a base section 33 with a section of a flow profile 43 that branches off to the left through 90°, a base section 34 with a section of a flow profile 44 that branches off to the right through 135° and a base section 35 with a section of a flow profile 45 that branches off to the right at 135°.

Of course, further variants can be made up from these base sections by closing off specific connections. For instance, the base section according to FIGS. 1 and 2 can be obtained by combining the bases 31 and 32, one of the connections located directly opposite one another then being closed off.

FIGS. 6, 7, 8 and 9, respectively, show base parts 31, 32, 33 and 35 in perspective.

The profiled bases made up from the five different base parts 31, 32, 33, 34 and 35 according to FIGS. 5*a* to 5*i* are found in the variants in FIGS. 10*a* to i. To enlarge the diameter of the base, rings have been placed around the latter, in particular the ring parts 56, 57, 58, 59. The ring parts 56 and 57 are shown on an enlarged scale in FIG. 11, which is identical to the variant in FIG. 10*g*.

The diameter of the modular inspection chamber according to the invention can be increased in a simple manner by means of these ring parts 56, 57, 58, 59.

The invention claimed is:

1. An inspection chamber comprising:

a plastic sleeve, a plastic base accommodated in the sleeve, and at least two branches connected to the sleeve, which base has a flow profile that extends between the two branches, wherein the base is made up of at least two separate base parts that are permanently fixed to one another at their edges facing one another through one technique from the group consisting of welding, fusing and gluing, and wherein the base has a plastic end wall or a plastic end ring on which the combined base parts are supported.

2. The inspection chamber according to claim 1, wherein the base comprises base parts forming a ring as well as central base parts, which base parts forming a ring are contiguous with the outer periphery of the central base parts, to the outer periphery of which base parts forming a ring the sleeve is connected, and are profiled correspondingly to the central base parts.

3. The inspection chamber according to claim 1, wherein the base parts are in contact with one another in a direction transverse to the longitudinal direction of a shaft.

4. The inspection chamber according to claim 1, wherein a shaft is provided that is connected to the sleeve.

5. The inspection chamber according to claim 4, wherein the shaft is double-walled with a smooth inner tube and a ribbed outer tube fixed to the inner tube.

6. The inspection chamber according to claim 4, wherein the end wall/end ring is fixed to one end of the sleeve and the other end of the sleeve is fixed to the shaft.

7. The inspection chamber according to claim 1, wherein each base part comprises a section of the flow profile.

8. The inspection chamber according to claim 1, wherein the branches are located opposite one another and the flow profile runs straight between them.

9. The inspection chamber according to claim 1, wherein at least two branches are oriented at approximately 90° with respect to one another and the flow profile runs in a curve between said branches.

10. The inspection chamber according to claim 1, wherein at least two branches are oriented at approximately 135° with respect to one another and the flow profile runs in a curve or obliquely between said branches.

11. The inspection chamber according to claim 1, wherein the base and the branches are positioned butting up to one another.

12. A set for a modular inspection chamber comprising:

a plastic sleeve, a plastic base accommodated in the sleeve, and at least two branches connected to the sleeve, wherein the base has a flow profile that extends between the two branches and wherein the base is made up of at least two separate base parts that are permanently fixed to one another at their edges facing one another, wherein the sleeve and central base parts have sections of flow profiles and the base parts form a ring which is profiled correspondingly to the central base parts and branches associated with the flow profiles of the base parts, wherein a plastic end wall or a plastic end ring closes off the sleeve, and wherein the plastic end wall or the plastic end ring is capable of providing support for the combination of base parts.

13. The set according to claim 12, comprising five central base parts, every two of which can be combined to give a base, which central base parts comprise:

a) a base part with one half of a flow profile that runs straight, b) a first right base part with one section of a flow profile that runs straight and a flow profile that branches off at approximately 90° from the flow profile that runs straight, c) a second right base part with one section of a flow profile that runs straight and a flow profile that branches off at approximately 135° from the flow profile that runs straight, d) a first left base part with one section of a flow profile that runs straight and a flow profile that branches off at approximately 90° from the flow profile that runs straight, and e) a second left base part with one section of a flow profile that runs straight and a flow profile that branches off at approximately 135° from the flow profile that runs straight.

14. The set according to claim 12, further comprising a shaft that can be joined to the sleeve.

15. The set according to claim 12, further comprising four base parts forming a ring that can be fitted around, in each case, two central base parts, which base parts forming a ring are profiled correspondingly to said central base parts.

* * * * *